US012158050B2

(12) United States Patent
Alsaeed et al.

(10) Patent No.: US 12,158,050 B2
(45) Date of Patent: Dec. 3, 2024

(54) MECHANICAL WELL CONTROL BARRIER IN SINGLE CASING WELLS

(71) Applicant: SAUDI ARABIAN OIL COMPANY, Dhahran (SA)

(72) Inventors: Mohammad Saeed Alsaeed, Dhahran (SA); Mansour Abdullah Alamer, Dammam (SA); Mohammed Eid Almukhlifi, Ad Dammam (SA); Mohammed K. Muqri, Dhahran (SA); Pandu Wirawan, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 13 days.

(21) Appl. No.: 18/056,493

(22) Filed: Nov. 17, 2022

(65) Prior Publication Data

US 2024/0167358 A1 May 23, 2024

(51) Int. Cl.
*E21B 33/04* (2006.01)
*E21B 33/03* (2006.01)

(52) U.S. Cl.
CPC ..... *E21B 33/04* (2013.01); *E21B 33/03* (2013.01); *E21B 2200/01* (2020.05)

(58) Field of Classification Search
CPC ..... E21B 33/04; E21B 2200/01
See application file for complete search history.

(56) References Cited

U.S. PATENT DOCUMENTS

| | | | | |
|---|---|---|---|---|
| 2,830,666 | A * | 4/1958 | Rhodes | E21B 34/02 166/97.1 |
| 5,031,695 | A * | 7/1991 | Cain | E21B 33/0422 166/208 |
| 5,109,923 | A * | 5/1992 | Koleilat | E21B 17/1007 166/382 |
| 7,069,987 | B2 * | 7/2006 | Kwasniewski | E21B 33/068 166/85.3 |
| 7,308,934 | B2 * | 12/2007 | Swagerty | E21B 43/26 166/177.5 |
| 10,352,123 | B2 | 7/2019 | Landry | |
| 11,220,883 | B1 | 1/2022 | Kellam et al. | |
| 2008/0277120 | A1 | 11/2008 | Hickie | |
| 2012/0012341 | A1 * | 1/2012 | White | E21B 33/12 166/85.1 |
| 2020/0248523 | A1 * | 8/2020 | Craycraft | E21B 33/04 |

* cited by examiner

*Primary Examiner* — Brad Harcourt
(74) *Attorney, Agent, or Firm* — Vorys, Sater, Seymour and Pease LLP

(57) ABSTRACT

A method of installing a mechanical barrier in a wellhead includes receiving a false bowl within a bowl of a casing head housing of the wellhead, generating a first sealed interface between the false bowl and the bowl with one or more first seals arranged about an exterior of the false bowl, receiving a plug within the false bowl, generating a second sealed interface between the plug and the false bowl with one or more second seals arranged about an exterior of the plug, and receiving a back-pressure valve within the plug.

14 Claims, 7 Drawing Sheets

MECHANICAL WELL CONTROL BARRIER IN SINGLE CASING WELLS

FIELD OF THE DISCLOSURE

The present disclosure relates generally to wellheads and, more particularly, to the installation of a mechanical well control barrier within a wellhead for a water supply well.

BACKGROUND OF THE DISCLOSURE

Due to the need for large volumes of water required to support the operational requirements of hydrocarbon producing wells, onshore water supply wells are often drilled to support such operations. The water produced may help in operations including, but not limited to, hydraulic injection and hydraulic fracturing.

The present disclosure was developed in order to optimize barriers and re-entry operations for wells utilized in the oil and gas industry, and more specifically, for water supply wells, which typically only employ a single casing string. Common practice in the drilling industry is to utilize only a hydraulic well control barrier when drilling water supply wells. However, in water supply wells that require drilling to deeper depths, well control can be of greater concern. In such a situation, the need for a mechanical barrier becomes more essential. While slickline or wireline plugs can be installed in some applications as mechanical barriers, the operations to install them can often be costly and time consuming.

Additionally, conventional water supply well wellhead configurations may be problematic in some situations, as discussed herein. In some cases, the wellhead configuration utilized has greater potential to expose the atmosphere to produced fluids because of leak points. Additionally, the wellhead configuration may result in limitations on future re-entry and well intervention options and operations.

For the foregoing reasons, there is a need for a device and method of installing a mechanical barrier into water wells encompassing a single casing string.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a method of installing a mechanical may include receiving a false bowl within a bowl of a casing head housing of the wellhead and generating a first sealed interface between the false bowl and the bowl with one or more first seals arranged about an exterior of the false bowl. The method of installation may further include receiving a plug within the false bowl and generating a second sealed interface between the plug and the false bowl with one or more second seals arranged about an exterior of the plug. The method may include the receiving of a back-pressure valve within the plug.

According to an embodiment consistent with the present disclosure, a false bowl assembly for a wellhead may include a false bowl configured to be received within a bowl of a casing head housing of the wellhead where the false bowl may include one or more first seals arranged about an exterior of the false bowl so that the first seals may seal against a sealing surface of the bowl. The false bowl assembly for a wellhead may further include a plug configured to be received within a false bowl, the plug including one or more second seals arranged about an exterior of the plug so that the second seals may seal against the false bowl. The false bowl assembly may further include a back-pressure valve configured to be received within the plug, wherein a combination of the false bowl, the plug, and the back-pressure valve received within the wellhead may provide a mechanical barrier to wellbore fluid flow through the wellhead.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
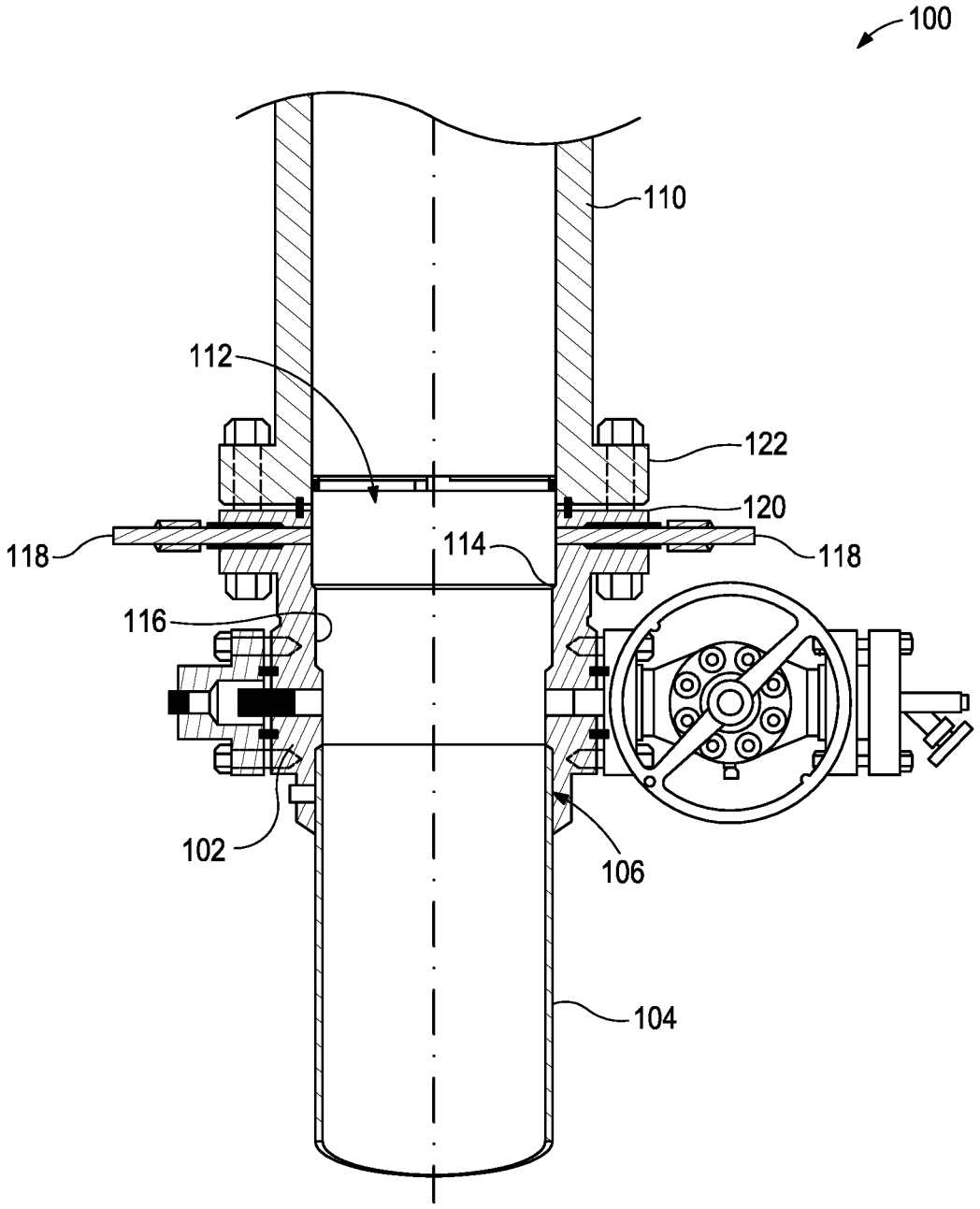
FIG. 1 is a schematic, cross-sectional side view of a wellhead according to one or more embodiments of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to installation of a well barrier system into a wellhead, and more particularly, to the installation of a well barrier system into the wellhead of a water supply well where a single casing string is secured to the wellhead and no production tubing is employed. The embodiments described herein can be advantageous over traditional barriers installed in water supply wells because the presently disclosed well barrier system allows for the installation of a testable mechanical barrier. Additionally, the well barrier system described herein mitigates the wear on secondary wellhead components that is a resultant effect of the traditional means of producing a single casing string water well. Furthermore, because many of the components utilized in the present embodiment are commonly manufactured and widely proven throughout the oil and gas industry, the disclosed apparatus and methodology could be easily implemented into current operations.

Because water producing wells are drilled into aquifers at relatively shallow depths, often only a single casing string lining the well is necessary. A casing string is a tubular that is installed after a wellbore has been drilled to the depth required and extends from surface to some specified depth below surface. The casing string assists in preventing borehole collapse and in mitigating the risk of formation fluids from entering the wellbore. Akin to the well construction of hydrocarbon producing wells, water wells may be capped at surface with a wellhead, which sits atop the casing string and consists of a configuration of permanently installed equipment.

The wellhead serves several purposes. The wellhead acts as a sealed barrier between the wellbore and the atmosphere. The wellhead also provides load support for each tubular run in (extended into) the wellbore. Further, the wellhead facilitates production of downhole fluids as it is the connection point from the downhole tubulars to the surface production equipment. Upon well construction completion, the wellhead will provide support for production equipment stacked upon it including, as an example, the production tree. In addition, the wellhead provides the connection point and load support for well control equipment, such as a blow out preventer (BOP).

As mentioned above, in most cases, water supply wells are drilled to relatively shallow depths and thus utilize only a single casing string (surface casing string). However, in some cases, a water well may require the borehole to be drilled beyond the depth of the surface casing string and thus employ additional tubulars. The following is an illustration of the operational steps that are common in drilling a water supply well deeper than the depth of the surface casing string, utilizing a conventional drilling rig.

Drilling deeper will result in a change of the wellbore formation pressure that is generally commensurate with depth. The change in formation pressure will require the setting of surface casing that covers the previously drilled interval. Once the surface casing is set and secured within the casing head housing, the BOP will be installed on top of the casing heading housing. Once the BOP is installed and tested, drilling can commence with a new drilling fluid having a density that is capable of maintaining the appropriate wellbore hydrostatic pressure necessary to withstand the changed formation pressure. Once the second section is drilled to total depth, in the case of a water supply well, a liner will be set in the wellbore. The liner serves the same purpose as a casing tubular except that the top of the liner will not extend back to surface but instead is hung off within the interior of the previous casing string.

Upon successful setting of the liner, the BOP will be removed allowing for installation of an adapter spool and a production master valve. In the present example, the adapter spool serves as a crossover between the casing head housing and the production equipment. The production tree master valve is installed atop the adapter spool and functions as a mechanical barrier to control all fluid within the wellbore. As such, when the BOP is removed, the master valve is the primary mechanical barrier to wellbore flow. The BOP will then be re-installed atop the production tree master valve to continue with downhole operations. Upon reaching total depth, sand screens are suspended from the shoe of the deepest set tubular to prevent unwanted sand production when the wellbore is ready to produce, in this example, below the liner. Once the sand screens are set, the water supply well may be properly secured. Securing the well first by hydraulic means requires displacing the wellbore with a fluid having a density sufficient to overcome the formation pressure at final depth (kill weight fluid), preventing wellbore flow to surface. Once displacement is complete, the master valve is closed, creating a mechanical barrier. With a hydraulic and mechanical barrier in place, the BOP may be removed and the upper portion of the production tree can be installed.

The wellhead configuration discussed above will be the same despite a water supply well containing a single casing string (shallow water well) or multiple liners (deeper water well). The wellhead will consist of a single casing head housing spool that secures the surface casing. Unlike conventional hydrocarbon wells, no production tubing head adapter is necessary because the water will be produced to surface directly through the casing (or through the casing and liners) without the need for production tubing. As such there is no need for a tubing head housing within the wellhead configuration.

In conventional hydrocarbon wells, the surface casing is secured within the casing housing by means of a casing hanger. The hanger provides a sealing area and a pressure testable area to ensure that the surface casing is secured within the casing head housing. A positive pressure test (i.e., one that indicates pressure is not dissipating as it is held) is indication that the risk of wellbore flow from the backside of the surface casing to the atmosphere is lowered. As briefly mentioned above, the tubing head adapter spool will sit directly atop the casing head spool. The tubing head adapter having at least two elastomer seals, will engage with the upper most tubular exposed at surface, acting as a hanger and creating a pressure testable seal.

Alternatively, in water wells, the casing head housing is welded directly to the surface casing. Thus eliminating the ability to utilize an elastomer seal and the ability to pressure test the seal between the surface casing and casing head housing. Also in contrast to a conventional well, because there is no tubing, a tubing head adapter spool is not installed atop the casing head housing spool. Instead, an adapter spool is installed. The adapter spool functions only as a crossover connection to the production equipment and does not provide any load support to any tubular.

The traditional wellhead configuration for water wells presents several disadvantages. First, because there is only a single casing string and no production tubing running to surface, there is no upward extended and exposed tubing end around which the adapter has the ability to seal. In a conventional hydrocarbon well, the engagement and subsequent seal of the tubing head adapter with the production tubing creates a barrier to the flange connections between the bodies of the casing head housing spool and the tubing head adapter. The ring gasket within the face of the upper flange of the casing head housing is therefore protected from possible exposure to wellbore fluid. Alternatively, in a traditional water well wellhead configuration, the ring gasket between the adapter spool lower flange and the casing head housing upper flange is exposed to wellbore pressure when the well is producing. Overtime, this may wear the ring gasket, potentially resulting in a leak of the produced fluid to the atmosphere.

Second, conventional water well wellhead configurations limit the ability to secure the wellbore for future re-entry or intervention. In some instances a rig may be utilized to secure the water well for re-entry. The rig is used to pump a kill weight fluid downhole, creating a hydraulic barrier. Alternatively, or in addition to, the master valve can be closed, creating a mechanical barrier to wellbore flow (as previously discussed). With the master valve closed, the upper portion of the production tree may be removed so that the BOP can be installed atop the master valve. Installation of the BOP secures the water well with a temporary secondary mechanical barrier so that the master valve can be re-opened to access the wellbore. With the BOP in place and the master valve in the open position, downhole tools (e.g., a pump) can re-enter the wellbore. However, downhole operations will be limited by the internal diameter of the master valve as it will dictate the outer diameter of the tools that may pass through the master valve. Alternatively, in some instances it may be favorable to secure the well by means of a wireline plug. Installation of a wireline plug creates a mechanical barrier without the need to displace the wellbore fluid with a kill weight fluid or hydraulic barrier. Such an operation requires use of a wireline unit as opposed to a conventional rig. Similar to the utilization of downhole tools, discussed above, the wireline plug size will be limited to the internal diameter of the master valve.

Third, each of the methods of securing the well require function of the master valve. Excessive function of the master valve is not optimal, since each open and close cycle of the master valve increases risk of damage and wear. Such damage and/or wear may require master valve replacement which can be costly.

According to embodiments of the present disclosure, a mechanical barrier may be introduced into a single casing string well that protects the ring gasket between the wellhead upper flange connections and the casing head housing flange, which is less limiting for future well re-entry operations and does not require functioning of the master valve. The mechanical barrier may comprise a false bowl assembly that includes a false bowl with a plug that houses a back-pressure valve. The false bowl assembly may be installed within the wellhead of a water supply well encompassing a single casing string that is secured (e.g., via welding) to a casing head housing of the wellhead. The false bowl assembly may be introduced into the wellhead using a false bowl running and retrieving tool, as well as a plug running and retrieval tool. Installation of the false bowl assembly consists of deploying casing into a drilled wellbore to a specified depth, securing the casing to a casing head housing, positioning a false bowl within a casing head housing, and positioning a retrievable plug with a retrievable back-pressure valve within the false bowl. Once properly installed, the false bowl assembly will enhance drilling operational safety by establishing a mechanical barrier during installation and removal of the production tree.

FIG. 1 is a schematic, cross-sectional side view of an example wellhead 100 that may employ the principles of the present disclosure. In some embodiments, the wellhead 100 may be situated at a wellsite located on the Earth's surface (i.e., a land-based operation), but could alternatively be installed subsea, without departing from the scope of the disclosure. The wellhead 100 may be configured for operation with a water supply well, but could alternatively be configured for operation with a hydrocarbon producing well, without departing from the scope of the disclosure.

As illustrated, the wellhead 100 includes a casing head housing 102 and a casing string or "casing" 104 that extends downward from the casing head housing 102 and into a drilled wellbore (not shown). An upper end 106 of the casing 104 may be extended partially into the interior of the casing head housing 102 and secured thereto. In at least one embodiment, for example, the upper end 106 of the casing 104 is welded to the casing head housing 102, thus hanging the casing 104 from the casing head housing 102. In other embodiments, however, the casing 104 may alternatively be secured within the casing head housing 102 by any other knowns means including, but not limited to, threading.

The wellhead 100 may also include a blow out preventer (BOP) 110 (partially visible) operatively coupled to the upper end of the casing head housing 102. The casing head housing 102 includes an "upper" flange 120 that allows the casing head housing 102 to be operatively coupled to wellhead 100 components. As illustrated, for example, the casing head housing 102 is operatively coupled to the BOP 110 via the upper flange 120 and a lower flange 122 of the BOP 110. The BOP 110 may help maintain pressure within the wellhead 100 as a mechanical barrier and provide a means of introducing tools and instruments into the casing head housing 102 and the casing 104.

The casing head housing 102 further defines or provides a bowl 112, which constitutes the interior and some or all of the inner radial surfaces of the casing head housing 102. The bowl 112 defines an angled landing shoulder 114 used to receive and seat a false bowl within the casing head housing 102, as described in more detail below. The bowl 112 also provides or defines a sealing surface 116 that provides a location to generate a sealed interface between the false bowl and the casing head housing 102. The casing head housing 102 may further include one or more lock down screws 118 (two shown) that may be used to help secure the false bowl within the bowl 112.

Figure 2:
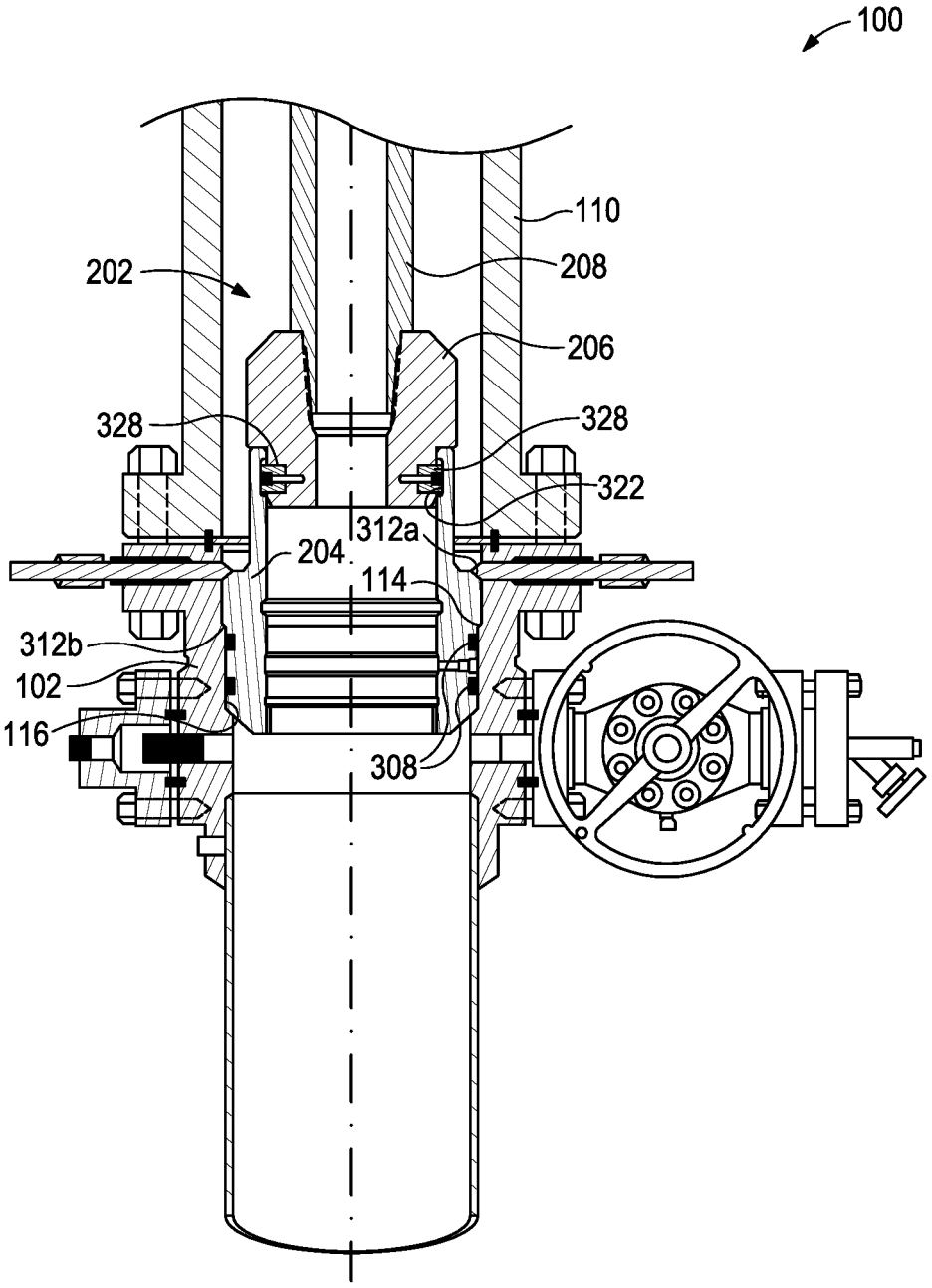
FIG. 2 is a schematic, cross-sectional side view of the wellhead with a false bowl installed by means of a false bowl running tool according to one or more embodiments of the present disclosure.

FIG. 2 is another schematic, cross-sectional side view of the wellhead 100 depicting installation of an example false bowl assembly 202, according to one or more embodiments. As briefly described above, the false bowl assembly 202 may be positioned within the casing head housing 102 to create a mechanical barrier to wellbore fluid flow should wellsite operations require removal of other mechanical barriers (i.e., a production tree or the BOP 110).

As illustrated, the false bowl assembly 202 may include a false bowl 204 configured to be received within and secured to the casing head housing 102. The false bowl 204 may be operatively coupled to a false bowl running tool 206 configured to introduce the false bowl 204 into the wellhead 100 and, more particularly, into the casing head housing 102. As illustrated, the false bowl running tool 206 may be coupled to drill pipe 208, which allows the combination false bowl 204 and false bowl running tool 206 to be run into the wellhead 100.

Figure 3:
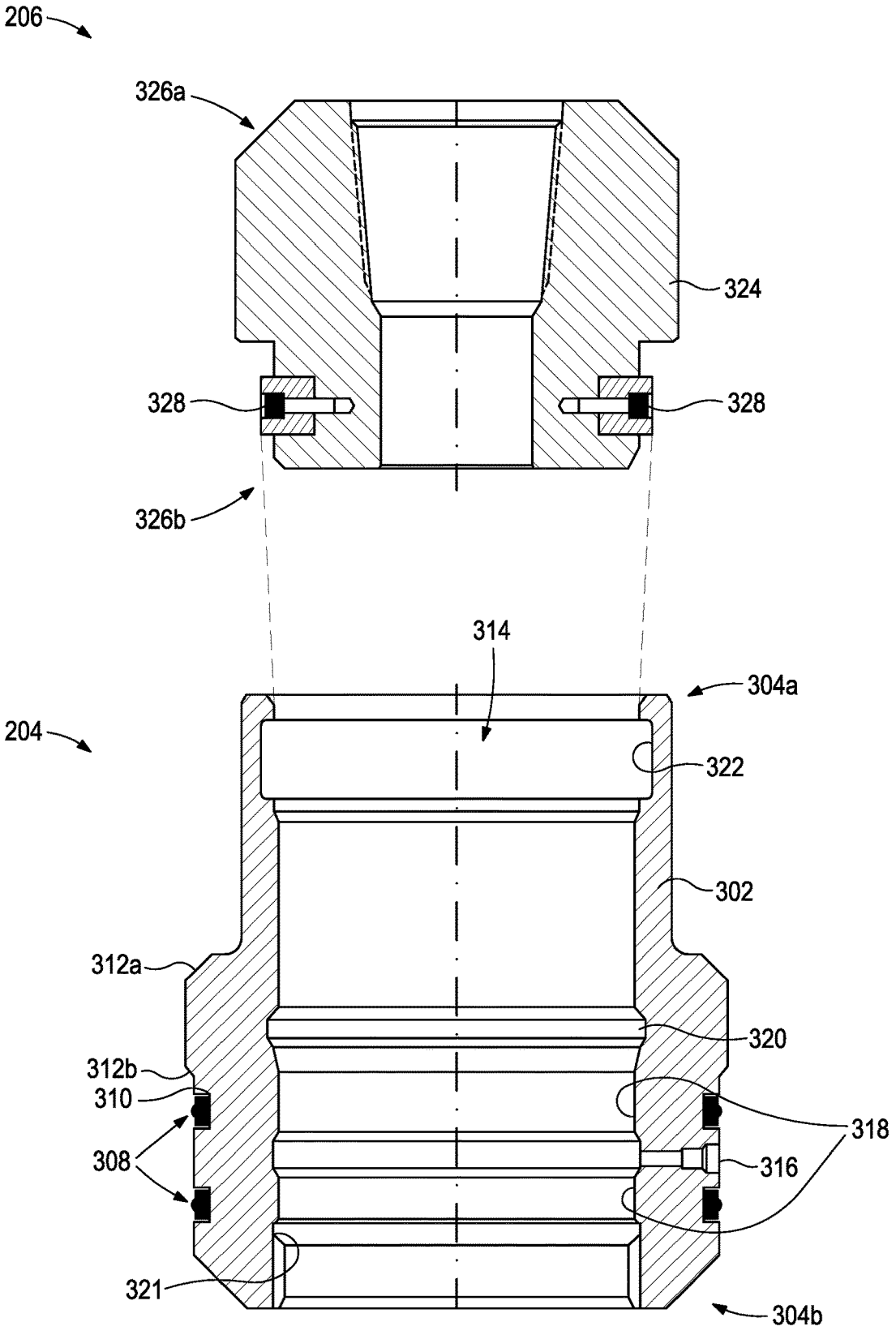
FIG. 3 is an exploded, cross-sectional side view the false bowl and the false bowl running tool, according to one or more embodiments of the present disclosure.

Referring briefly to FIG. 3, illustrated is an exploded, cross-sectional side view of the false bowl 204 and the false bowl running tool 206, according to one or more embodiments. As illustrated, the false bowl 204 comprises a generally cylindrical body 302 having a first or "upper" end 304*a* and a second or "lower" end 304*b* opposite the upper end 304*a*.

The false bowl 204 may further include one or more seals 308 (two shown) arranged about the exterior of the body 302 and configured to seal against the sealing surface 116 (FIG. 1) provided in the bowl 112 (FIG. 1) of the casing head housing 102 (FIG. 1). The seals 308 may comprise, for example, elastomeric O-rings or the like, but could alternatively comprise other types of seals suitable for generating a sealed interface between the bowl 112 and the false bowl 204. In the illustrated embodiment, the false bowl 204 defines corresponding grooves 310 sized to receive the seals 308.

An upper shoulder 312*a* may be provided or otherwise defined by the body 302 on the exterior of the body 302. The upper shoulder 312*a* may be configured to align with the lock down screws 118 (FIG. 1) of the casing head housing 102 (FIGS. 1 and 2) when the false bowl 204 is received within the bowl 112 (FIG. 1). Securing the lock down screws 118 onto the upper shoulder 312*a* will achieve mechanical retention between the false bowl 204 and the casing head housing 102.

A lower shoulder 312*b* may also be provided or otherwise defined by the body 302 on the exterior of the body 302. The lower shoulder 312*b* may be configured to locate and mate with the landing shoulder 114 (FIG. 1) defined within the bowl 112 (FIG. 1) of the casing head housing 102 (FIGS. 1 and 2).

The body 302 further defines an inner channel 314 extending between the upper and lower ends 304*a,b* and generally defining the interior of the false bowl 204. A testing orifice 316 extends through the sidewall of the body 302 and provides fluid communication into the inner channel 314 of the false bowl 204. As described in further detail below, the testing orifice 316 helps facilitate the ability to test the sealing efficiency of the seals 308 and generally test the sealed interface between the false bowl 204 and the interior of the casing head housing 102 (FIGS. 1 and 2).

The inner channel 314 may define or provide a pair of sealing surfaces 318 axially spaced from each other. As illustrated, the testing orifice 316 interposes the sealing surfaces 318, which are configured to provide a sealing location for a plug (not shown) that forms part of the false bowl assembly 202 (FIG. 2). The inner channel 314 may further define or provide a lock ring groove 320 and a distal groove 321. Each of the grooves 320, 321 may provide locations where the plug may be secured to the false bowl 204, as will be described in more detail below.

A running tool groove 322 may be defined within the inner channel 314 at or near the upper end 304*a* of the body 302. The running tool groove 322 provides a location where the false bowl running tool 206 can be secured to the false bowl 204. In at least one embodiment, the running tool groove 322 may comprise a J-slot mechanism designed to receive corresponding matable members of the false bowl running tool 206.

The false bowl running tool 206 comprises a generally cylindrical body 324 having a first or "upper" end 326*a* and a second or "lower" end 326*b* opposite the upper end 326*a*. The lower end 326*b* may be sized and otherwise configured to be received within the inner channel 314 of the false bowl 204. One or more matable members 328 (two shown) may be provided at or near the lower end 326*b* to secure the false bowl running tool 206 to the false bowl 204. The matable members 328 may be configured to locate and mate with the running tool groove 322 provided within the inner channel 314. In at least one embodiment, the matable members 328 may comprise pins configured to mate with the J-slot mechanism of the running tool groove 322. Once the pins have entered the J-slot mechanism, the false bowl running tool 206 may be rotated so that the pins are locked within the J-slot mechanism and the assembly may be deployed into the casing head housing 102. In other embodiments, however, the matable members 328 may comprise other type of securing devices or means capable of securing the false bowl running tool 206 to the false bowl 204.

The upper end 326*a* of the false bowl running tool 206 may be configured to be operatively coupled to the drill pipe 208 (FIG. 2) by means of a threaded engagement, e.g., American Petroleum Institute (API) threads. In other embodiments the threads of the false bowl running tool 206 may be manufactured as necessary to properly make up to the desired drill pipe 208 connection.

Referring again to FIG. 2, the false bowl assembly 202 is run into the casing head housing 102 by operatively coupling the false bowl running tool 206 to the false bowl 204 and advancing the false bowl running tool 206 into the casing head housing 102. As described above, the matable members 328 of the false bowl running tool 206 are matable with the running tool groove 322 of the false bowl 204 such that the combination can be simultaneously deployed into the casing head housing 102.

Moreover, the false bowl running tool 206 is coupled to the drill pipe 208 and advanced into the wellhead 100 until the lower shoulder 312*b* of the false bowl 204 locates and lands on the landing shoulder 114 of the bowl 112. In this position, the seals 308 may sealingly engage the sealing surface 116 of the bowl 112. Once the false bowl 204 properly lands on the landing shoulder 114, the upper shoulder 312*a* of the body 302 aligns with the lock down screws 118, which may be actuated (tightened) to mechanically retain the false bowl 204 within the casing head housing 102.

Once the lock down screws 118 secure the false bowl 204 within the casing head housing 102, the matable members 328 of the false bowl running tool 206 may be disengaged from the running tool groove 322 of the false bowl 204, thereby allowing the false bowl running tool 206 to be separated from the false bowl 204 and removed from the wellhead 100. As briefly discussed above, the matable members 328 may comprise pins that engage the J-slot mechanism of the running tool groove 322. In such embodiments, disengaging the running tool 206 from the false bowl 204 requires opposite rotation from the running tool 206 initial makeup such that the pins may be released from the J-slot mechanism.

Figure 4:
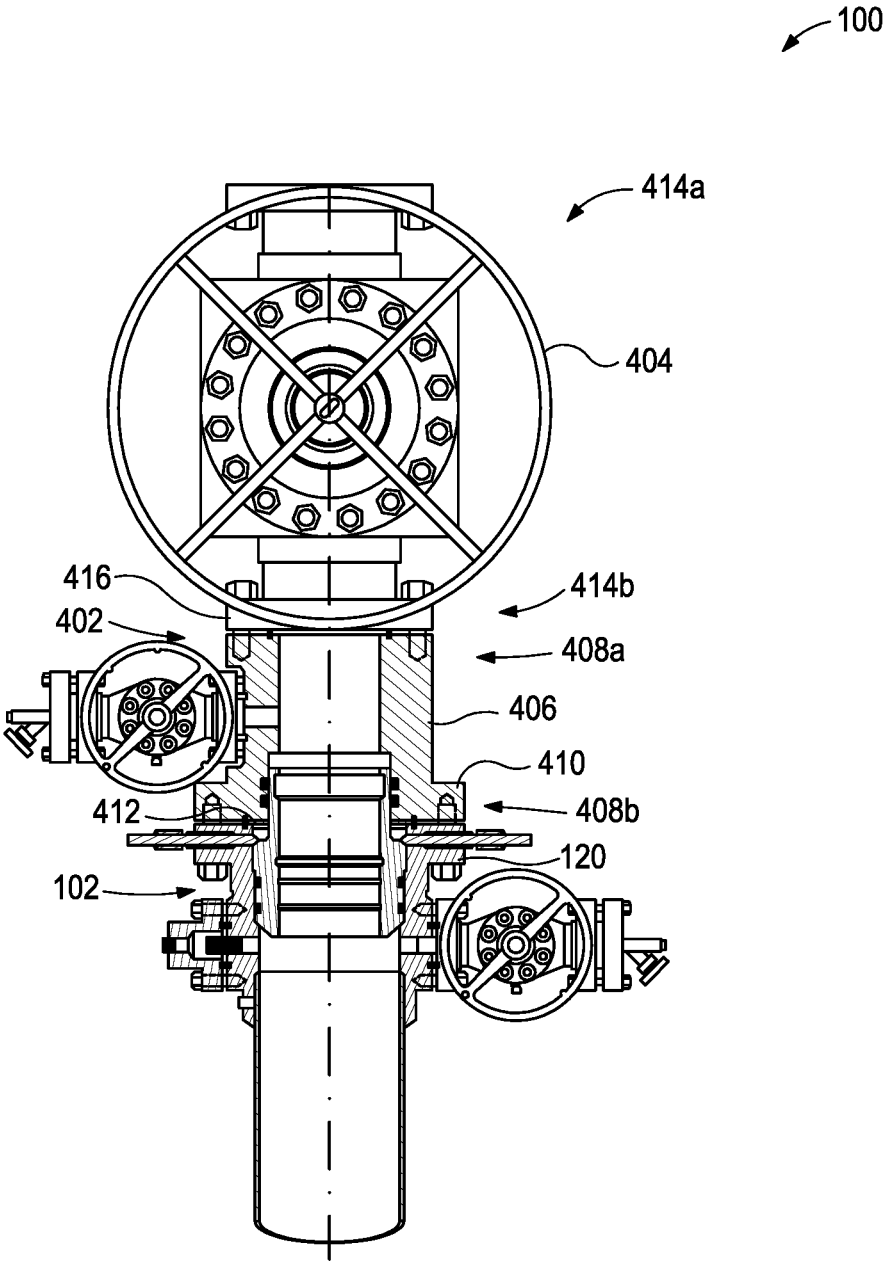
FIG. 4 is a schematic, cross-section side view of the wellhead with the false bowl installed and an adapter spool and a master valve installed according to one or more embodiments of the present disclosure.

FIG. 4 is another schematic, partial cross-sectional side view of the wellhead 100. As illustrated, the wellhead 100 may further include an adapter spool 402 and a master valve 404. The adapter spool 402 may include a generally cylindrical, hollow body 406 having a first or "upper" end 408*a* and a second or "lower" end 408*b* opposite the upper end 408*a*. The lower end 408*b* provides a flange 410 that can be operatively coupled to the upper flange 120 of the casing head housing 102, thereby coupling the adapter spool 402 to the casing head housing 102. In some embodiments, a ring gasket 412 may interpose the flanged connection between the opposing flanges 120, 410. The ring gasket 412 may be made of a variety of materials such as, but not limited to, carbon steel, but could alternatively comprise other types of ring gaskets suitable for the operation.

The master valve 404 may be secured atop the adapter spool 402. More particularly, the master valve 404 has a first or "upper" end 414*a* and a second or "lower" end 414*b* opposite the upper end 414*a*. The lower end 414*b* may provide a flange 416 that may be operatively coupled to the upper end 408*a* of the adapter spool 402 at the opposing flange 410. Moreover, the master valve 404 may comprise a generally cylindrical body with a hollow interior sized to receive an interior valve, e.g., a gate valve. In other embodiments, the interior valve may comprise other types of valves appropriately suited to the operation.

Figure 5B:
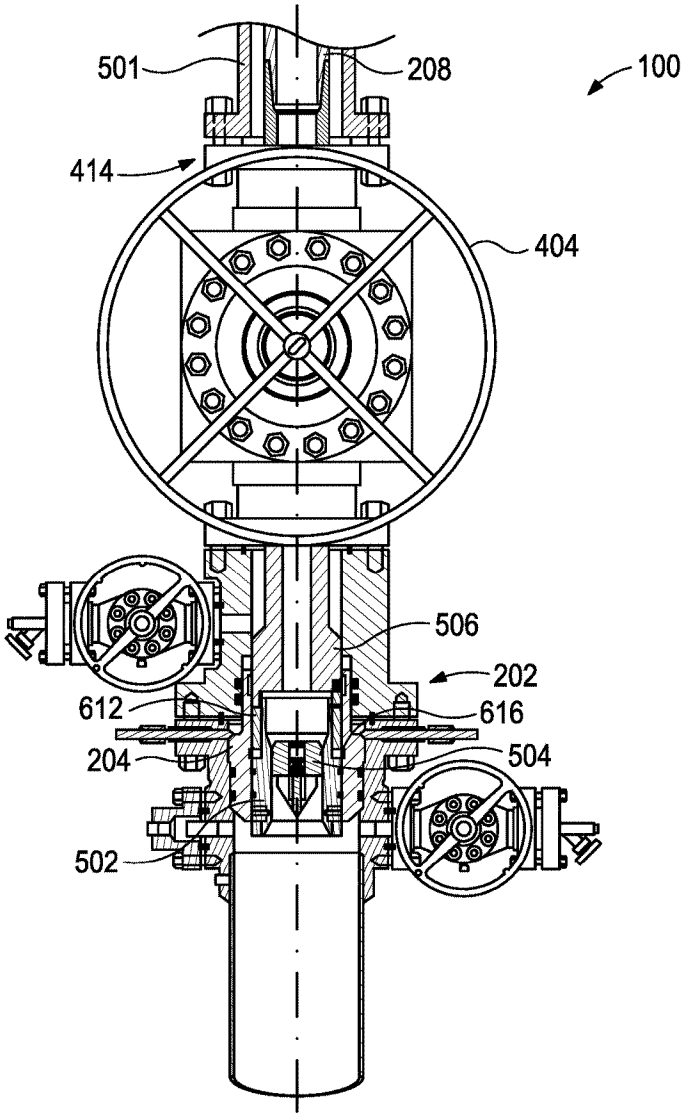
FIG. 5B is a schematic, cross-section view of the view of the wellhead with the false bowl installed and the plug installed by means of the plug running tool, according to one or more embodiments of the present disclosure.
Figure 5A:
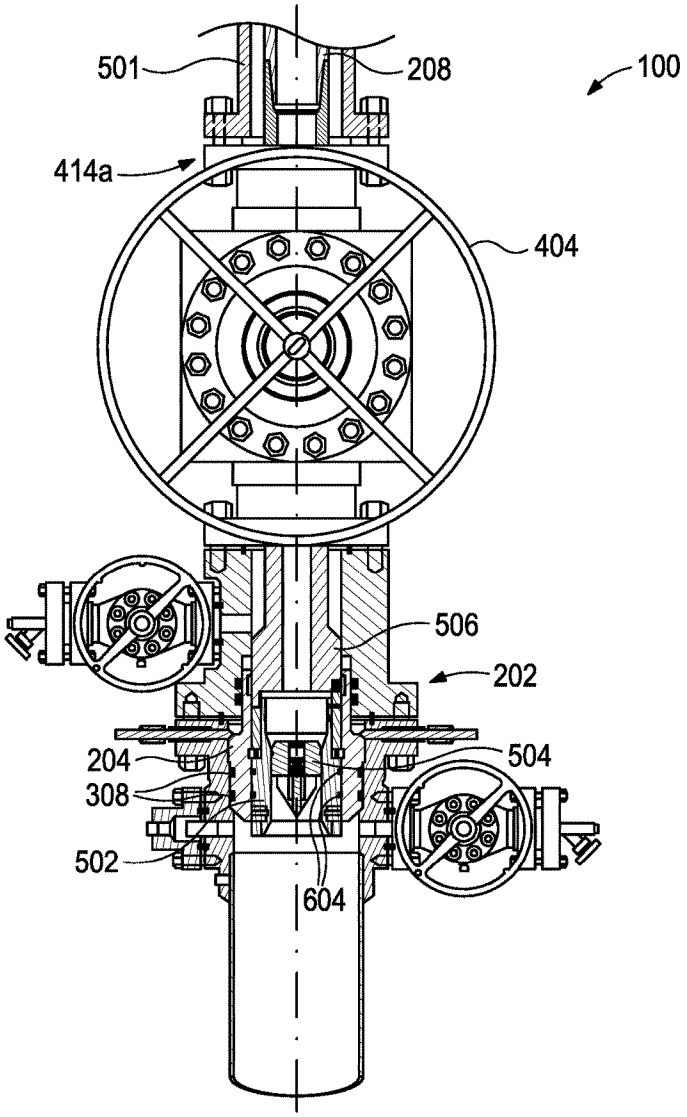
FIG. 5A is a schematic, cross-section view of the wellhead with the false bowl installed and the plug positioned within the false bowl by means of the plug running tool, according to one or more embodiments of the present disclosure.

FIGS. 5A and 5B are schematic, cross-sectional side views of the wellhead 100 depicting progressive installation of additional components of the false bowl assembly 202, according to one or more embodiments. As illustrated, a lubricator 501 may be operatively coupled to the upper end 414*a* of the master valve 404 and configured to receive and introduce the additional components of the false bowl assembly 202 into the wellhead 100. In other embodiments, the lubricator 501 may be replaced with a BOP or the like.

The false bowl assembly 202 may further include a retrievable plug 502 and a back-pressure valve 504. The back-pressure valve 504 may be configured to be received within the plug 502, and the plug 502 may be configured to be received by and secured within the false bowl 204. In at least one embodiment, to accomplish this, the plug 502 may be operatively coupled to a plug running tool 506 configured to introduce the plug 502 into the wellhead 100 via the lubricator 501 (or a BOP) and the master valve 404. Once the plug 502 is received and secured within the false bowl 204, the plug running tool 506 may be disengaged from the plug 502 and removed from the wellhead 100. The back-pressure valve 504 may then be operatively coupled to a running tool (not shown) so that it may be deployed into the wellhead 100 via the lubricator 501 (or a BOP) and the master valve 404. Alternatively, in one or more embodiments, the back-pressure valve 504 is first installed within the interior of the plug 502, and the plug 502 may then be operatively coupled to a plug running tool 506 configured to introduce the combination plug 502 and back-pressure valve 504 into the wellhead 100 via the lubricator 501 (or a BOP) and the master valve 404. The plug running tool 506 may be coupled to drill pipe 208, which allows the plug 502 and the plug running tool 506 to be advanced into the wellhead 100 until locating the false bowl 204. In embodiments where the back-pressure valve 504 is installed separately, a back-pressure running tool (not shown) may be coupled to drill pipe 208, which allows the back-pressure valve 504 to be advanced into the plug 502.

Figure 6:
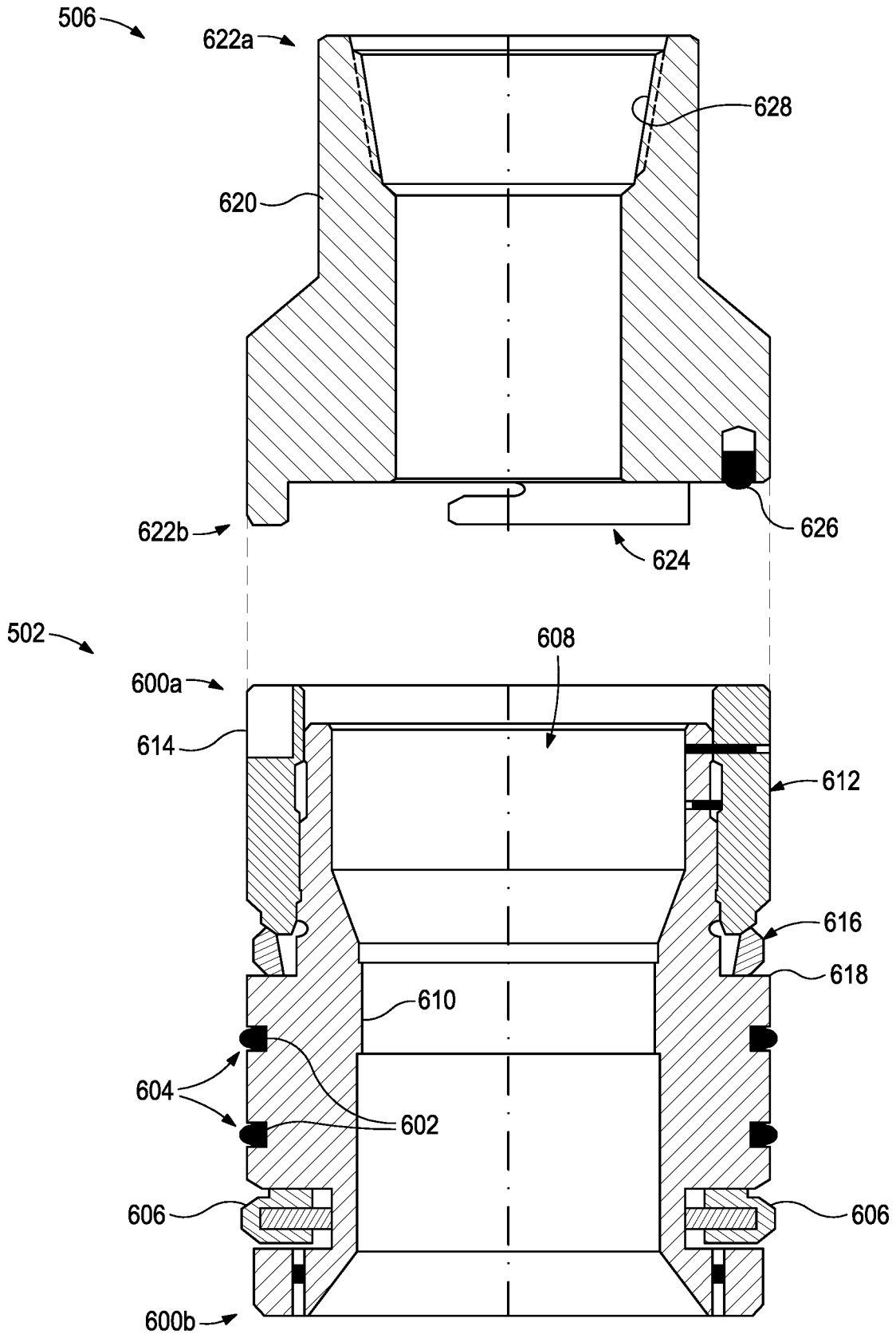
FIG. 6 is an exploded, cross-sectional side view the plug and the plug running tool, according to one or more embodiments of the present disclosure.

Referring briefly to FIG. 6, illustrated is an exploded, cross-sectional side view of the plug 502 and the plug running tool 506, according to one or more embodiments. As illustrated, the plug 502 comprises a generally cylindrical body having a first or "upper" end 600*a* and a second or "lower" end 600*b* opposite the upper end 600*a*. The plug 502 provides two grooves 602 extending circumferentially around its outer diameter and sized to receive corresponding seals 604. The seals 604 may comprise, for example, elastomer O-rings or the like, but could alternatively comprise other types of seals suitable for generating a seal.

The plug 502 may further include or provide one or more anti-rotation pins 606 (two shown) secured to the plug and engageable with the distal groove 321 (FIG. 3) of the false bowl 204 (FIGS. 5A-5B). Once the pins 606 are received within the distal groove 321 may be an indication that the plug 502 is properly secured in place within the false bowl 204.

The plug 502 further provides and otherwise defines an interior 608 extending between the upper and lower ends 600*a,b*. A back-pressure profile 610 may be defined within the interior 608 and configured to receive and seat the back-pressure valve 504 (FIGS. 5A-5B). This will allow the back-pressure valve 504 to be installed inside the false bowl 204 (FIGS. 5A-5B) to act as a mechanical barrier for the well.

In the present embodiment, the back-pressure profile 610 of the plug 502 encompasses internal threads compatible to external threads located on the outside diameter of the back-pressure valve 504. Once the back-pressure valve 504 is received within the back-pressure profile 610 of the plug 502, the back-pressure valve 504 may be rotated such that the threads may engage and secure the back-pressure valve 504 in place.

The plug 502 further includes an energizing mandrel 612 located at the upper end 600*a* of the plug 502. The energizing mandrel 612 may be configured to mate with the plug running tool 506, thus allowing the plug 502 to be run into the wellhead 100 (FIGS. 5A-5B) on the plug running tool 506. In the illustrated embodiment, the energizing mandrel 612 is fitted with a J-slot mechanism 614, including one or more pins, that may be configured to mate with corresponding matable J-slot features provided on the plug running tool 506.

The plug 502 may further include a lock ring 616 that may be disposed between a distal end of the energizing mandrel 612 and a radial shoulder 618 defined on the exterior of the plug 502. The lock ring 616 may be configured to be received within the lock ring groove 320 (FIG. 3) of the false bowl 204 (FIGS. 3 and 5A-5B). In at least one embodiment, the lock ring 616 may be activated by rotating the energizing mandrel 612, which will drive the energizing mandrel downward and force the lock ring 616 radially outward and into the lock ring groove 320.

Still referring to FIG. 6, the plug running tool 506 includes a generally cylindrical hollow body 620 having a first or "upper" end 622*a* and a second or "lower" end 622*b* opposite the upper end 622*a*. The lower end 622*b* of the plug running tool 506 may be configured to mate with and otherwise be operatively coupled to the upper end 600*a* of the plug 502 and, more particularly, operatively coupled to the energizing mandrel 612. In the illustrated embodiment, the lower end 622*a* of the plug running tool 506 may be fitted with a corresponding J-slot mechanism 624 configured to mate with the J-slot mechanism 614 provided on the energizing mandrel 612. In other embodiments, however, the J-slot mechanisms 614, 624 may be replaced with any means reasonable to facilitate engagement between the plug 502 and the plug running tool 506, without departing from the scope of the disclosure.

In some embodiments, the plug running tool 506 may further include one or more anti-rotation pins 626 (one shown), which may be received by the plug 502 and configured to confirm the engagement of the mating J-slot mechanisms 614, 624 before applying rotation to engage the matable connections of the plug 502. Moreover, the upper end 622*a* of the plug running tool 506 may be configured to be operatively coupled to the drill pipe 208 (FIGS. 5A-5B) by means of a threaded engagement 628, e.g., American Petroleum Institute (API) threads. In other embodiments, the threads 628 of the plug running tool 506 may be manufactured as necessary to properly make up to the desired drill pipe 208 connection.

Referring again to FIGS. 5A-5B, when it is desired to install the plug 502 and the back-pressure valve 504, the lubricator 501 (or a BOP) may be operatively coupled to the upper end 414*a* of the master valve 404. The back-pressure valve 504 may first be installed within the plug 502 by mating the back-pressure valve 504 with the profile 610 (FIG. 6). Moreover, the plug running tool 506 may be coupled to the plug 502, as generally described above, and the rig (e.g., a conventional, land-based drilling rig) may pick up the drill pipe 208 by hoisting means so that the plug running tool 506 may be mechanically coupled to the plug 502. Proper alignment and mating between the plug 502 and the plug running tool may be confirmed by first aligning the anti-rotation pin 626 (FIG. 6) of the plug running tool 506 within the upper end 600*a* of the plug 502 before rotation is applied to engage the plug 502 within the plug running tool 506 via the matable J-slot mechanisms 614, 624. With the anti-rotation pin 626 in place, the plug running tool 506 may be rotated by rotating the drill pipe 208, which mechanically secures the matable J-slot mechanisms 614, 624. The plug running tool 506, in combination with the plug 502, may then be lowered into the wellhead 100 by adding extensions of drill pipe 208 until the lower end 600*b* of the plug 502 is received within the false bowl 204.

Referring specifically to FIG. 5A, the combination of the plug running tool 506 and the plug 502 is lowered into the wellhead 100 and advanced until extended into the inner channel 314 (FIG. 3) of the false bowl 204. As the plug 502 is received within the false bowl 204, the seals 604 of the plug 502 may align with and sealingly engage the sealing surfaces 318 (FIG. 3) of the inner channel 314. Moreover, the plug anti-rotation pins 606 (FIG. 6) may locate and be received within the distal groove 321 (FIG. 3) of the false bowl 204. Engagement between the plug anti-rotation pins 606 and the distal groove 321 may confirm proper positioning of the plug 502 so that that the drill pipe 208 may be rotated, resulting in the corresponding rotation of the plug running tool 506 and the plug 502.

When the plug 502 is properly received within the false bowl 204, the seals 308 of the false bowl 204 and the seals 604 of the plug 502 may generally axially align within the wellhead 100. The seals 308, 604 may then be pressure tested simultaneously via the testing orifice 316 (FIG. 3) of the false bowl 204. A successful pressure test will indicate proper sealing engagement of both sets of seals 308, 604.

In FIG. 5B, rotating the drill pipe 208 results in the subsequent activation (actuation) of the energizing mandrel 612. By rotating the drill pipe 208, the energizing mandrel 612 may be lowered downward and correspondingly apply an axial load on the lock ring 616 of the plug 502. The axial load causes the lock ring 616 to radially expand into the lock ring groove 322 (FIG. 3) of the false bowl 204. With the lock ring 616 received within the lock ring groove 322, the plug 502 may be secured (retained) within the false bowl 204. In one or more embodiments, a calculated amount of overpull may be applied to the drill pipe 208 and thus to the plug running tool 506 and the plug 502. A lack of movement in the drill pipe 208 may provide a positive indication that the plug 502 is properly retained within the false bowl 204, and a mechanical barrier formed by the false bowl assembly 202 has successfully been provided within the casing head housing 102 of the wellhead 100.

Once it is confirmed that the plug 502 is properly installed within the false bowl 204, the plug running tool 506 may be disconnected from the plug 502 by disengaging the matable J-slot mechanisms 614, 624 (FIG. 6). This may be accomplished by rotating the drill pipe 208 in the opposite direction. Once released, the plug running tool 506 is pulled out of the wellhead 100 and back to surface by removing the extensions of the drill pipe 208.

Figure 7:
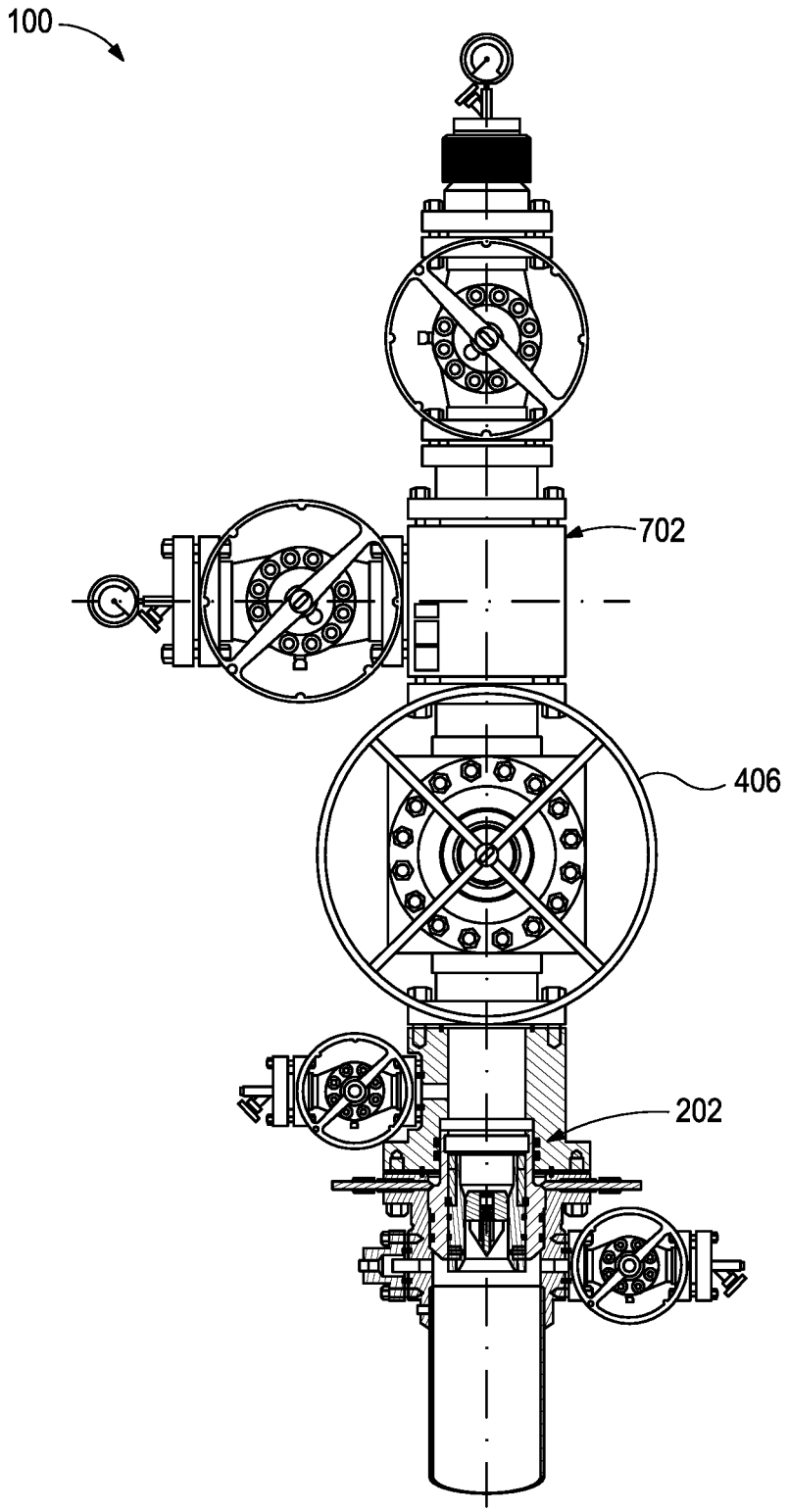
FIG. 7 is a schematic, cross-section view of the wellhead depicting the final installation of the production tree.

FIG. 7 is another schematic, partial cross-sectional side view of the wellhead 100. In FIG. 7, the lubricator 501 (FIGS. 5A-5B) has been removed, and a production tree 702 is operatively coupled to the master valve 404. The false bowl assembly 202 installed in the wellhead 100 may operate as a mechanical barrier with pressure tested seals and connections, which may reduce the risk of possible fluid leak to the atmosphere. At this point, the wellbore (not shown) extending from the wellhead 100 is in a state permissible for re-entry by means of a conventional rig or wireline unit.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A method of installing a mechanical barrier in a wellhead, comprising:

receiving a false bowl within a bowl of a casing head housing of the wellhead;

generating a first sealed interface between the false bowl and the bowl with one or more first seals arranged about an outer circumferential exterior of the false bowl;

advancing a plug with one or more second seals arranged about an exterior of the plug into the false bowl until the one or more second seals axially align with the one or more first seals;

generating a second sealed interface between the plug and the false bowl with the one or more second seals arranged about an exterior of the plug;

pressure testing the one or more first and second seals via a testing orifice defined in the false bowl; and receiving a back-pressure valve within the plug.

2. The method of claim 1, wherein receiving the false bowl within the bowl of the casing head housing comprises:

operatively coupling the false bowl to a false bowl running tool;

advancing the false bowl into the casing head housing on the false bowl running tool; and engaging a lower shoulder defined on an exterior of the false bowl against a landing shoulder defined within the bowl.

3. The method of claim 2, further comprising:

actuating one or more lock down screws provided by the casing head housing and thereby engaging an upper shoulder provided on the outer circumferential exterior of the false bowl; and securing the false bowl within the casing head housing with the one or more lock down screws.

4. The method of claim 1, wherein receiving the plug within the false bowl comprises receiving one or more anti-rotation pins of the plug within a distal groove defined within the false bowl.

5. The method of claim 1, wherein receiving the plug within the false bowl comprises actuating a lock ring arranged about an exterior of the plug and thereby receiving the lock ring within a lock ring groove defined within the false bowl.

6. The method of claim 5, wherein the plug further includes an energizing mandrel located at an upper end of the plug, and wherein actuating the lock ring comprises rotating the energizing mandrel and thereby driving the energizing mandrel downward and forcing the lock ring radially outward and into engagement with the lock ring groove.

7. The method of claim 1, wherein receiving the plug within the false bowl comprises:

operatively coupling the plug to a plug running tool; and advancing the plug and the back-pressure valve into the wellhead and into the false bowl as coupled to the plug running tool.

8. A false bowl assembly for a wellhead, comprising:

a false bowl configured to be received within a bowl of a casing head housing of the wellhead, the false bowl including one or more first seals arranged about an outer circumferential exterior of the false bowl to seal against a sealing surface of the bowl;

a plug configured to be received within the false bowl and including one or more second seals arranged about an exterior of the plug to seal against the false bowl;

a testing orifice defined in the false bowl to pressure test the one or more first and second seals once the plug is advanced into the false bowl to axially align the one or more second seals with the one or more first seals; and a back-pressure valve configured to be received within the plug, wherein a combination of the false bowl, the plug, and the back-pressure valve received within the wellhead provides a mechanical barrier to wellbore fluid flow through the wellhead.

9. The assembly of claim 8, wherein the casing head housing provides one or more lock down screws actuatable to engage an upper shoulder provided on the outer circumferential exterior of the false bowl and thereby secure the false bowl within the casing head housing.

10. The assembly of claim 8, wherein a lower shoulder is defined on the outer circumferential exterior of the false bowl and is engageable with a landing shoulder defined within the bowl as the false bowl is introduced into the bowl.

11. The assembly of claim 8, wherein the plug includes one or more anti-rotation pins engageable with a distal groove defined within the false bowl.

12. The assembly of claim 8, wherein the plug includes a lock ring arranged about an exterior of the plug and actuatable to be received within a lock ring groove defined within the false bowl.

13. The assembly of claim 12, wherein the plug further includes an energizing mandrel located at an upper end of the plug and rotatable to actuate the lock ring.

14. The assembly of claim 13, wherein the energizing mandrel is configured to operatively couple the plug to a plug running tool that runs the plug into the wellhead, and wherein rotating the plug running tool rotates the energizing mandrel and thereby actuates the lock ring.

* * * * *